US011075051B2

(12) United States Patent
Zou et al.

(10) Patent No.: US 11,075,051 B2
(45) Date of Patent: Jul. 27, 2021

(54) RADIATION EMISSION DEVICE

(71) Applicant: SHANGHAI UNITED IMAGING HEALTHCARE CO., LTD., Shanghai (CN)

(72) Inventors: Yun Zou, Shanghai (CN); Xi Zhang, Shanghai (CN); Dun Li, Shanghai (CN); Yanfeng Du, Shanghai (CN); Haining Sun, Shanghai (CN)

(73) Assignee: SHANGHAI UNITED IMAGING HEALTHCARE CO., LTD., Shanghai (CN)

( * ) Notice: Subject to any disclaimer, the term of this patent is extended or adjusted under 35 U.S.C. 154(b) by 101 days.

(21) Appl. No.: 16/236,422

(22) Filed: Dec. 29, 2018

(65) Prior Publication Data

US 2019/0206653 A1 Jul. 4, 2019

Related U.S. Application Data

(63) Continuation of application No. PCT/CN2017/120435, filed on Dec. 31, 2017.

(51) Int. Cl.

| | |
|---|---|
| ***H01J 35/10*** | (2006.01) |
| ***H01J 35/06*** | (2006.01) |
| ***H01J 35/18*** | (2006.01) |

(52) U.S. Cl.

CPC ..... *H01J 35/101* (2013.01); *H01J 35/06* (2013.01); *H01J 35/18* (2013.01); *H01J 2235/068* (2013.01); *H01J 2235/085* (2013.01)

(58) Field of Classification Search

None

See application file for complete search history.

(56) References Cited

U.S. PATENT DOCUMENTS

| | | | | |
|---|---|---|---|---|
| 3,846,006 | A * | 11/1974 | Atlee | H01J 9/045 445/28 |
| 4,631,742 | A | 12/1986 | Oliver | |
| 4,964,148 | A | 10/1990 | Klostermann et al. | |
| 6,125,169 | A | 9/2000 | Wandke et al. | |
| 10,420,518 | B2 * | 9/2019 | Harada | H05G 1/56 |
| 2001/0019601 | A1 | 9/2001 | Tkahashi et al. | |
| 2010/0142680 | A1 * | 6/2010 | August | H01J 35/02 378/138 |

(Continued)

FOREIGN PATENT DOCUMENTS

| | | |
|---|---|---|
| JP | 2013093235 A | 5/2013 |
| JP | 2014067665 A | 4/2014 |

OTHER PUBLICATIONS

International Search Report in PCT/CN2017/120435 dated Sep. 14, 2018, 4 pages.

(Continued)

*Primary Examiner* — Hoon K Song
(74) *Attorney, Agent, or Firm* — Metis IP LLC

(57) ABSTRACT

A radiation emission device is provided. The radiation emission device may include an anode, a first cathode, a heating device and an enclosure. The first cathode may include a first filament that emit an electron beam striking the anode to generate radioactive rays for imaging. The heating device may be located outside of the first cathode and be configured to warm up the anode. The enclosure may be configured to enclosure the first cathode and the anode.

19 Claims, 5 Drawing Sheets

(56) References Cited

U.S. PATENT DOCUMENTS

| | | | | |
|---|---|---|---|---|
| 2011/0222662 | A1 | 9/2011 | Behling | |
| 2012/0082299 | A1* | 4/2012 | Tang | H01J 35/06 378/123 |
| 2016/0189911 | A1 | 6/2016 | Ausburn | |
| 2017/0092457 | A1 | 3/2017 | Harada et al. | |
| 2019/0116654 | A1* | 4/2019 | Miller | H01J 35/06 |

OTHER PUBLICATIONS

Written Opinion in PCT/CN2017/120435 dated Sep. 14, 2018, 4 pages.
The Extended European Search Report in European Application No. 17933859.5 dated Jan. 7, 2020, 9 pages.

* cited by examiner

RADIATION EMISSION DEVICE

CROSS REFERENCE TO RELATED APPLICATION

This present application is a continuation of International Application No. PCT/CN2017/120435 filed on Dec. 31, 2017, the entire contents of which are incorporated herein by reference.

TECHNICAL FIELD

The present disclosure generally relates to a radiation emission device, and more particularly, to the radiation emission device with a heating component.

BACKGROUND

For a radiation device (e.g., a CT device), an electron beam may be generated from a cathode and accelerated toward an anode. Then radioactive rays (e.g. X-rays) may be generated when the electron beam strikes the anode. The radioactive rays may pass through a subject, and some projection data relating to the rays traversing the subject may be obtained. However, before imaging, the non-invasive imaging device may need to be warmed up in order to protect the anode. Conventionally, the imaging device may need to idle for a long time to be preheated using the same filament that generates radiation for imaging or treatment. Therefore, it is desired to provide an efficient way to warm up the anode and prevent unnecessary exposure of the radioactive rays by patients and/or operators (e.g., doctors, imaging technicians, nurses).

SUMMARY

In accordance with some embodiments of the disclosed subject matter, a radiation emission device including a component for preheating an anode target of the radiation emission device is provided.

An aspect of the present disclosure relates to a radiation emission device. The radiation emission device may include an anode, a first cathode, a heating device, and an enclosure. The first cathode may include a first filament that may emit an electron beam striking the anode to generate radioactive rays. The heating device may be located outside of the first cathode and be configured to warm up the anode. The enclosure may be configured to enclose the first cathode and the anode.

In some embodiments, the heating device may include a second cathode, and the second cathode is a filament or disk.

In some embodiments, the second cathode may include a second filament.

In some embodiments, the electron beam from the second filament is configured to move along a radial direction of the anode when the second filament warms up the anode.

In some embodiments, a focal spot generated by the second filament may be bigger than a focal spot generated by the first filament.

In some embodiments, a diameter of the second filament may be bigger than a diameter of the first filament.

In some embodiments, the second filament may be a coil including 1 to 100 turns.

In some embodiments, the second filament may be a coil having a pitch ranging from 0.01 mm to 2 mm.

In some embodiments, the second filament may be a coil with a diameter ranging from 0.05 mm to 0.8 mm.

In some embodiments, the radiation emission device may further include an imaging power circuit and a heating power circuit. The imaging power circuit may supply a radiation voltage to the first cathode to emit the electron beam striking the anode to generate the radioactive rays. The heating power circuit may supply a heating voltage to the heating device for warming up the anode, and the radiation voltage may be higher than the heating voltage.

In some embodiments, the heating voltage may be 0 KV to 30 KV.

In some embodiments, a power of the heating device may be 100 W to 10 KW.

In some embodiments, the radiation emission device may include an electromagnetic induction heating device.

In some embodiments, the anode further may include a resistance wire, and the heating device may be configured to heat the resistance wire.

In some embodiments, the first filament may be configured to emit an electron beam of first energy for heating the anode under the heating voltage, and emit an electron beam of second energy for generating the radioactive rays for, e.g., imaging under the radiation voltage.

In some embodiments, the intensity of the electron beam of first energy may be lower than the intensity of the electron beam of second energy.

In some embodiments, the radiation emission device may further include an irradiation window allowing the radioactive rays to pass through to travel towards a subject, and the distance between the irradiation window and the heating device may be bigger than the distance between the irradiation window and the first cathode.

In some embodiments, the irradiation window may include a cover plate.

In some embodiments, the radiation emission device may include a rotor configured to drive the anode to rotate on the shaft and a sleeve configured to support the shaft via at least one bearing. The rotor may be mechanically connected to the shaft.

Another aspect of the present disclosure relates to a system for heating a radiation emission device. The system may include an anode, a first cathode, and a heating device located outside of the first cathode. The system may provide a heating voltage to the heating device to heat the anode. The system may provide a radiation voltage to the first cathode.

In some embodiments, the system may generate a heating focal spot on the anode by applying the heating voltage to the heating device. The system may generate a radiation focal spot on the anode by applying the radiation voltage to the first cathode. The heating focal spot may be bigger than the radiation focal spot.

In some embodiments, the heating voltage may be lower than the radiation voltage.

In some embodiments, the time duration for the heating device to heat the anode may be 0.1 minute to 5 minutes.

Another aspect of the present disclosure relates to a system for heating a radiation emission device. The system may include an anode, a first cathode containing a first filament configured to emit an electron beam striking the anode to generate radioactive rays. The first filament may be configured to emit an electron beam of first energy for heating the anode under a heating voltage, and emit an electron beam of second energy for generating the radioactive rays for imaging under a radiation voltage.

In some embodiments, intensity of the electron beam of first energy is lower than intensity of the electron beam of second energy.

Another aspect of the present disclosure relates to a system for heating a radiation emission device. The system may include an anode, a first cathode containing a first filament configured to emit an electron beam striking the anode to generate radioactive rays. The system may further include a heating device configured to warm up the anode without generating x-ray radiation. The system may further include an enclosure configured to enclose the first cathode and the anode.

Additional features will be set forth in part in the description which follows, and in part will become apparent to those skilled in the art upon examination of the following and the accompanying drawings or may be learned by production or operation of the examples. The features of the present disclosure may be realized and attained by practice or use of various aspects of the methodologies, instrumentalities and combinations set forth in the detailed examples discussed below.

BRIEF DESCRIPTION OF THE DRAWINGS

The present disclosure is further described in terms of exemplary embodiments. These exemplary embodiments are described in detail with reference to the drawings. These embodiments are non-limiting examples, in which like reference numerals represent similar structures throughout the several views of the drawings, and wherein.

DETAILED DESCRIPTION

Figure 1:
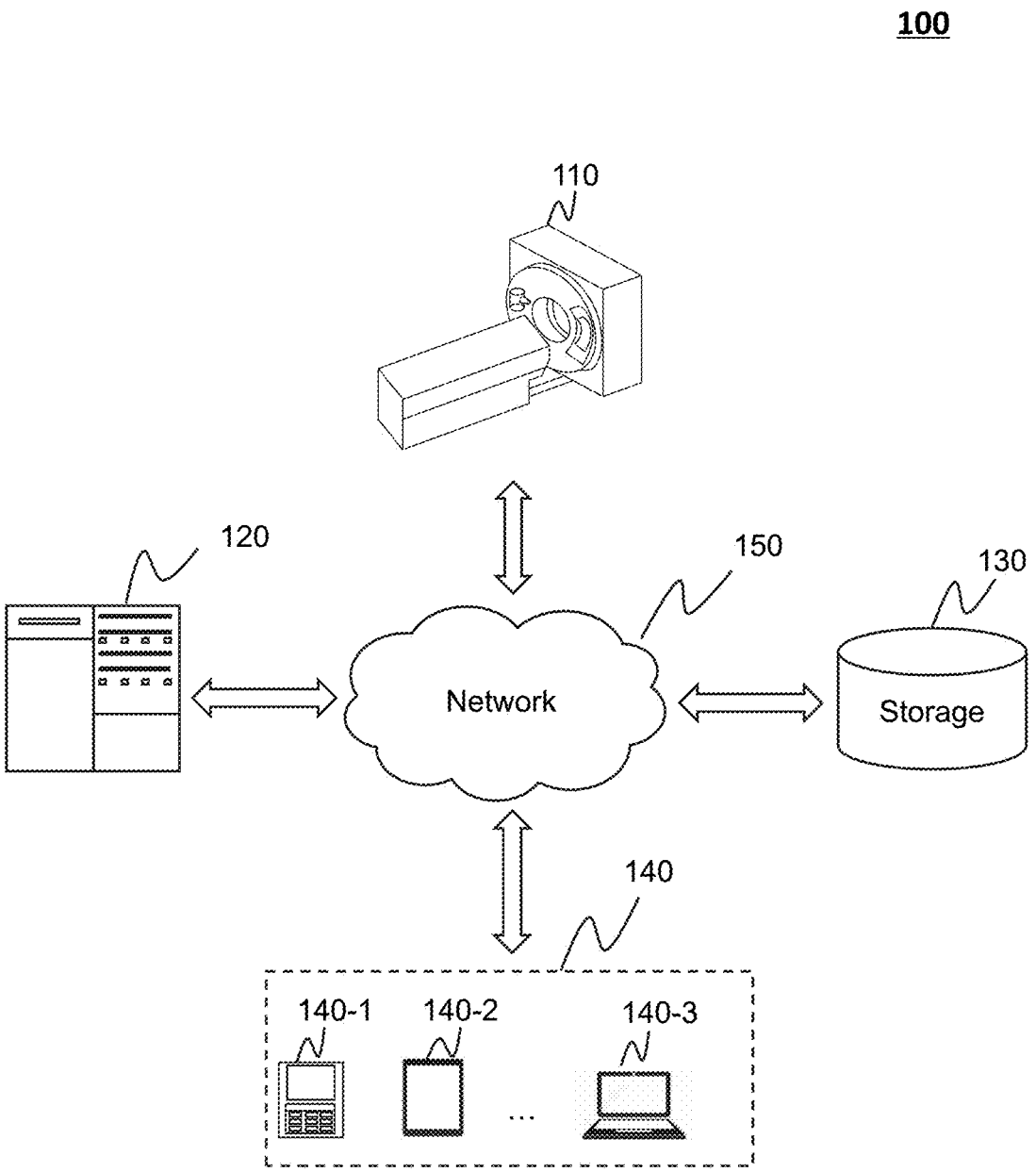
FIG. 1 is a schematic diagram illustrating an exemplary non-invasive imaging system according to some embodiments of the present disclosure.

In the following detailed description, numerous specific details are set forth by way of examples in order to provide a thorough understanding of the relevant disclosure. However, it should be apparent to those skilled in the art that the present disclosure may be practiced without such details. In other instances, well-known methods, procedures, systems, components, and/or circuitry have been described at a relatively high-level, without detail, in order to avoid unnecessarily obscuring aspects of the present disclosure. Various modifications to the disclosed embodiments will be readily apparent to those skilled in the art, and the general principles defined herein may be applied to other embodiments and applications without departing from the spirits and scope of the present disclosure. Thus, the present disclosure is not limited to the embodiments shown, but to be accorded the widest scope consistent with the claims.

It will be understood that the term "system," "unit," "module," and/or "block" used herein are one method to distinguish different components, elements, parts, section or assembly of different level in ascending order. However, the terms may be displaced by another expression if they may achieve the same purpose.

It will be understood that when a unit, module or block is referred to as being "on," "connected to" or "coupled to" another unit, module, or block, it may be directly on, connected or coupled to the other unit, module, or block, or intervening unit, module, or block may be present, unless the context clearly indicates otherwise. As used herein, the term "and/or" includes any and all combinations of one or more of the associated listed items.

The terminology used herein is for the purposes of describing particular examples and embodiments only, and is not intended to be limiting. As used herein, the singular forms "a," "an," and "the" may be intended to include the plural forms as well, unless the context clearly indicates otherwise. It will be further understood that the terms "include," and/or "comprise," when used in this disclosure, specify the presence of integers, devices, behaviors, stated features, steps, elements, operations, and/or components, but do not exclude the presence or addition of one or more other integers, devices, behaviors, features, steps, elements, operations, components, and/or groups thereof.

An aspect of the present disclosure relates to a radiation emission device. Different from a traditional radiation emission device (e.g., the X-ray tube), the radiation emission device disclosed herein may further include a heating device. The heating device may be configured to warm up the anode of the radiation emission device. The heating device may be located outside of the cathode of the radiation emission device. In some embodiments, the heating device may include a filament. The filament is to generate the electron beam and the electron beam is accelerated to a certain energy and strikes the anode for warming up the anode. Further, the time for warming up the anode may be reduced to approximately 0.1 minute to 5 minutes with the heating device as disclosed herein. In some embodiments, the heating device may be an electromagnetic induction heating device. After the anode is warmed up, the radiation emission device may generate radioactive rays (e.g., the X-rays) for, e.g., imaging, radiotherapy.

FIG. 1 is a schematic diagram illustrating an exemplary non-invasive imaging system according to some embodiments of the present disclosure. As shown in FIG. 1, the non-invasive imaging system 100 may include a scanner 110, a processing device 120, a storage device 130, one or more terminals 140, and a network 150. The components of the imaging system 100 may be connected in one or more of various ways. Merely by way of example, as illustrated in FIG. 1, the scanner 110 may be connected to the processing device 120 through the network 150. As another example, the scanner 110 may be connected to the processing device 120 directly. As a further example, the storage device 130 may be connected to the processing device 120 directly or through the network 150. As still a further example, one or more terminals 140 may be connected to the processing device 120 directly or through the network 150.

The scanner 110 may generate or provide image data via scanning a subject, or a part of the subject. The scanner 10 may include a single-modality scanner and/or multi-modality scanner. The single-modality may include, for example, a computed tomography (CT) scanner. In some embodiments, the CT scanner may be a spiral CT scanner. The multi-modality scanner may include a single photon emission computed tomography-computed tomography (SPECT-CT) scanner, a positron emission tomography-computed tomography (CT-PET) scanner, a computed tomography-ultra-sonic (CT-US) scanner, a digital subtraction angiography-computed tomography (DSA-CT) scanner, or the like, or a combination thereof. In some embodiments, the subject may include a body, a substance, an object, or the like, or a combination thereof. In some embodiments, the subject may include a specific portion of a body, such as the head, the thorax, the abdomen, a knee, or the like, or a combination thereof. In some embodiments, the subject may include a specific organ, such as an esophagus, a trachea, a bronchus, a stomach, a gallbladder, a small intestine, a colon, a bladder, a ureter, a uterus, a fallopian tube, etc.

In some embodiments, the scanner 110 may transmit the image data via the network 150 to the processing device 120, the storage device 130, and/or the terminal(s) 140. For example, the image data may be sent to the processing device 120 for further processing, or may be stored in the storage device 130.

The processing device 120 may process data and/or information obtained from the scanner 110, the storage device 130, and/or the terminal(s) 140. For example, the processing device 120 may reconstruct an image based on projection data collected by the scanner 110. In some embodiments, the processing device 120 may be a single server or a server group. The server group may be centralized or distributed. In some embodiments, the processing device 120 may be local or remote. For example, the processing device 120 may access information and/or data from the scanner 110, the storage 130, and/or the terminal(s) 140 via the network 150. As another example, the processing device 120 may be directly connected to the scanner 110, the terminal(s) 140, and/or the storage 130 to access information and/or data. In some embodiments, the processing device 120 may be implemented on a cloud platform. For example, the cloud platform may include a private cloud, a public cloud, a hybrid cloud, a community cloud, a distributed cloud, an inter-cloud, a multi-cloud, or the like, or a combination thereof.

Figure 2:
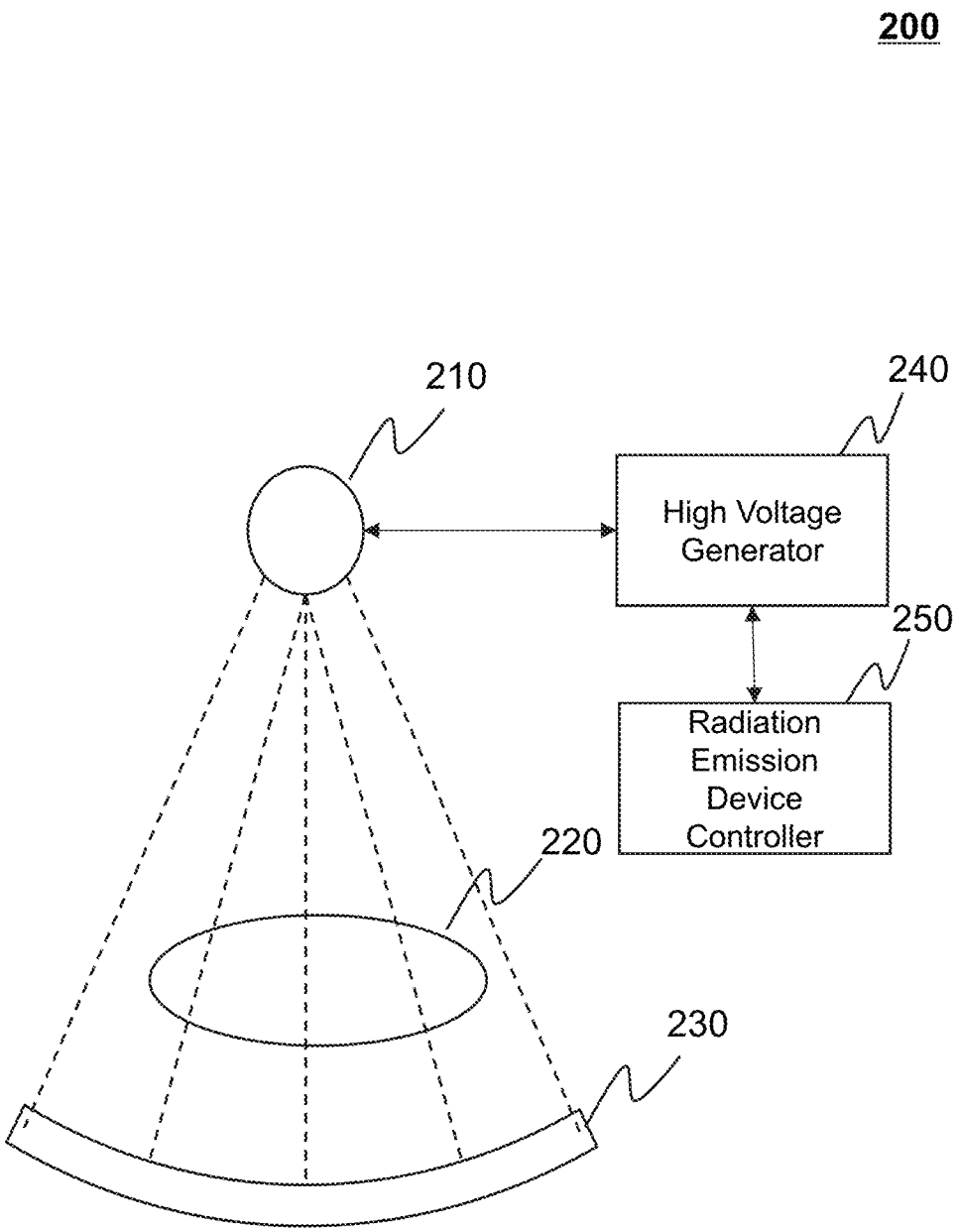
FIG. 2 is a schematic diagram illustrating an exemplary imaging apparatus in the scanner according to some embodiments of the present disclosure.

In some embodiments, the processor device 120 may further include a radiation emission device controller 250 as illustrated in FIG. 2. The radiation emission device controller 250 may generate a control signals relating to a working mode of the scanner 110. A working mode may include a working mode and a warm-up mode. The working mode may refer to a process that the scanner 110 generates radiation beams and acquire image data. The warm-up mode may refer to a process during which a component (e.g. a tube of the scanner 110) is warmed up to a specific temperature or temperature range (e.g., 2000 degrees Celsius to 2500 degrees Celsius) before the scanner 110 generate radiation beams and acquire image data. More descriptions relating to the radiation emission device controller 250 may be found in the description of FIG. 2

The storage device 130 may store data, instructions, and/or any other information. In some embodiments, the storage device 130 may store data obtained from the scanner 110, the processing device 120, and/or the terminal(s) 140. In some embodiments, the storage device 130 may store data and/or instructions that the processing device 120 may execute or use to perform exemplary methods described in the present disclosure. In some embodiments, the storage device 130 may include a mass storage, a removable storage, a volatile read-and-write memory, a read-only memory (ROM), or the like, or any combination thereof. Exemplary mass storage may include a magnetic disk, an optical disk, a solid-state drive, etc. Exemplary removable storage may include a flash drive, a floppy disk, an optical disk, a memory card, a zip disk, a magnetic tape, etc. Exemplary volatile read-and-write memory may include a random access memory (RAM). Exemplary RAM may include a dynamic RAM (DRAM), a double date rate synchronous dynamic RAM (DDR SDRAM), a static RAM (SRAM), a thyristor RAM (T-RAM), and a zero-capacitor RAM (Z-RAM), etc. Exemplary ROM may include a mask ROM (MROM), a programmable ROM (PROM), an erasable programmable ROM (EPROM), an electrically erasable programmable ROM (EEPROM), a compact disk ROM (CD-ROM), and a digital versatile disk ROM, etc. In some embodiments, the storage device 130 may be implemented on a cloud platform as described elsewhere in the disclosure. Merely by way of example, the cloud platform may include a private cloud, a public cloud, a hybrid cloud, a community cloud, a distributed cloud, an inter-cloud, a multi-cloud, or the like, or any combination thereof.

In some embodiments, the storage device 130 may be connected to the network 150 to communicate with one or more other components in the imaging system 100 (e.g., the processing device 120, the terminal(s) 140, etc.). One or more components in the imaging system 100 may access the data or instructions stored in the storage device 130 via the network 150. In some embodiments, the storage device 130 may be part of the processing device 120.

The terminal(s) 140 may be connected to and/or communicate with the scanner 110, the processing device 120, and/or the storage device 130. For example, the terminal(s) 140 may obtain a processed image from the processing device 120. As another example, the terminal(s) 140 may obtain image data acquired by the scanner 110 and transmit the image data to the processing device 120 to be processed. In some embodiments, the terminal(s) 140 may include a mobile device 140-1, a tablet computer 140-2, a laptop computer 140-3, or the like, or any combination thereof. For example, the mobile device 140-1 may include a mobile phone, a personal digital assistance (PDA), a gaming device, a navigation device, a point of sale (POS) device, a laptop, a tablet computer, or the like, or any combination thereof. In some embodiments, the terminal(s) 140 may include an input device, an output device, etc. The input device may include alphanumeric and other keys that may be implemented on a keyboard, a touch screen (for example, with haptics or tactile feedback), a speech input, an eye tracking input, a brain monitoring system, or any other comparable input mechanism. The input information received through the input device may be transmitted to the processing device 120 via, for example, a bus, for further processing. Other types of the input device may include a cursor control device, such as a mouse, a trackball, or cursor direction keys, etc. The output device may include a display, a speaker, a printer, or the like, or a combination thereof. In some embodiments, the terminal(s) 140 may be part of the processing device 120.

The network 150 may include any suitable network that can facilitate exchange of information and/or data for the imaging system 100. In some embodiments, one or more components of the imaging system 100 (e.g., the scanner 110, the processing device 120, the storage device 130, the terminal(s) 140, etc.) may communicate information and/or data with one or more other components of the imaging system 100 via the network 150. For example, the processing device 120 may obtain image data from the scanner 110 via the network 150. As another example, the processing device 120 may obtain user instruction(s) from the terminal (s) 140 via the network 150. The network 150 may be and/or include a public network (e.g., the Internet), a private network (e.g., a local area network (LAN), a wide area network (WAN)), etc.), a wired network (e.g., an Ethernet network), a wireless network (e.g., an 802.11 network, a Wi-Fi network, etc.), a cellular network (e.g., a Long Term Evolution (LTE) network), a frame relay network, a virtual private network (VPN), a satellite network, a telephone network, routers, hubs, witches, server computers, and/or any combination thereof. For example, the network 150 may include a cable network, a wireline network, a fiber-optic network, a telecommunications network, an intranet, a wireless local area network (WLAN), a metropolitan area network (MAN), a public telephone switched network (PSTN), a Bluetooth™ network, a ZigBee™ network, a near field communication (NFC) network, or the like, or any combination thereof. In some embodiments, the network 150 may include one or more network access points. For example, the network 150 may include wired and/or wireless network access points such as base stations and/or internet exchange points through which one or more components of the imaging system 100 may be connected to the network 150 to exchange data and/or information.

It is understood that the non-invasive imaging system is provided for illustration purposes and not intended to limit the scope of the present disclosure. The radiation emission device including a heating device or component may be configured to emit radiation used for purposes other than imaging. For instance, the radiation emission device may be part of a radiotherapy device and configured to generate radiation for treatment purposes.

This description is intended to be illustrative, and not to limit the scope of the present disclosure. Many alternatives, modifications, and variations will be apparent to those skilled in the art. The features, structures, methods, and other characteristics of the exemplary embodiments described herein may be combined in various ways to obtain additional and/or alternative exemplary embodiments. For example, the storage device 130 may be a data storage including cloud computing platforms, such as, public cloud, private cloud, community, and hybrid clouds, etc. However, those variations and modifications do not depart from the scope of the present disclosure.

FIG. 2 is a schematic diagram illustrating an exemplary imaging apparatus 200 in the scanner 110 according to some embodiments of the present disclosure. The imaging apparatus 200 may include a radiation emission device 210, a detector 230, and a high voltage generator 240. During a scanning process, a subject 220 may reside between the radiation emission device 210 and the detector 230. In some embodiments, the imaging apparatus 200 may be implemented in the non-invasive imaging system 100, such as a computed tomography (CT) system, a computed radiography (CR) system, a digital radiography (DR) system, a CT-positron emission tomography (PET) system, or a CT-magnetic resonance imaging (MRI) system.

The radiation emission device 210 may emit radiation rays (e.g., the X-rays) toward the subject 220. The radiation emission device 210 may include an X-ray tube. For example, the X-ray tube may generate X-rays with a power supply provided by the high voltage generator 240. In some embodiments, the high voltage generator 240 may include one or more electric circuits supplying voltages of different magnitudes to the radiation emission device 210. In some embodiments, the radiation emission device 210 may include an anode, a first cathode, a rotor, a sleeve, and an enclosure. In some embodiments, the radiation emission device 210 may further include a heating device that is configured to warm up the anode. More descriptions relating to the configuration of the radiation emission device 210 may be found in elsewhere in the present disclosure. See, e.g., FIG. 3 and the description thereof.

In some embodiments, the radiation emission device controller 250 may generate a control signal to select a mode of the radiation emission device 210. The radiation emission device 210 may be in one of the modes including, e.g., idle, working (or imaging), warm-up, and off. The radiation emission device controller 250 may control operations of the high-voltage generator 240 based on the control signal. For example, upon receipt of a control signal related to an imaging mode generated by the radiation emission device controller 250, the high-voltage generator 240 may provide a radiation voltage (e.g., 100 KV) to the first cathode in the radiation emission device 210 for emitting the electron beams, and the detector 230 may detect signals, on the basis of which the processing device 120 may obtain imaging data for imaging reconstruction. As another example, upon receipt of a control signal relating to a warm-up mode generated by the radiation emission device controller 250, the high-voltage generator 240 may provide a heating voltage (e.g., 10 KV-30 KV) to a heating device contained in the radiation emission device 210 to warm up the radiation emission device 210.

This description is intended to be illustrative, and not to limit the scope of the present disclosure. Many alternatives, modifications, and variations will be apparent to those skilled in the art. The features, structures, methods, and other characteristics of the exemplary embodiments described herein may be combined in various ways to obtain additional and/or alternative exemplary embodiments. For example, the radiation emission device 210 may include one or more circuits connected to the high voltage generator 240.

Figure 3:
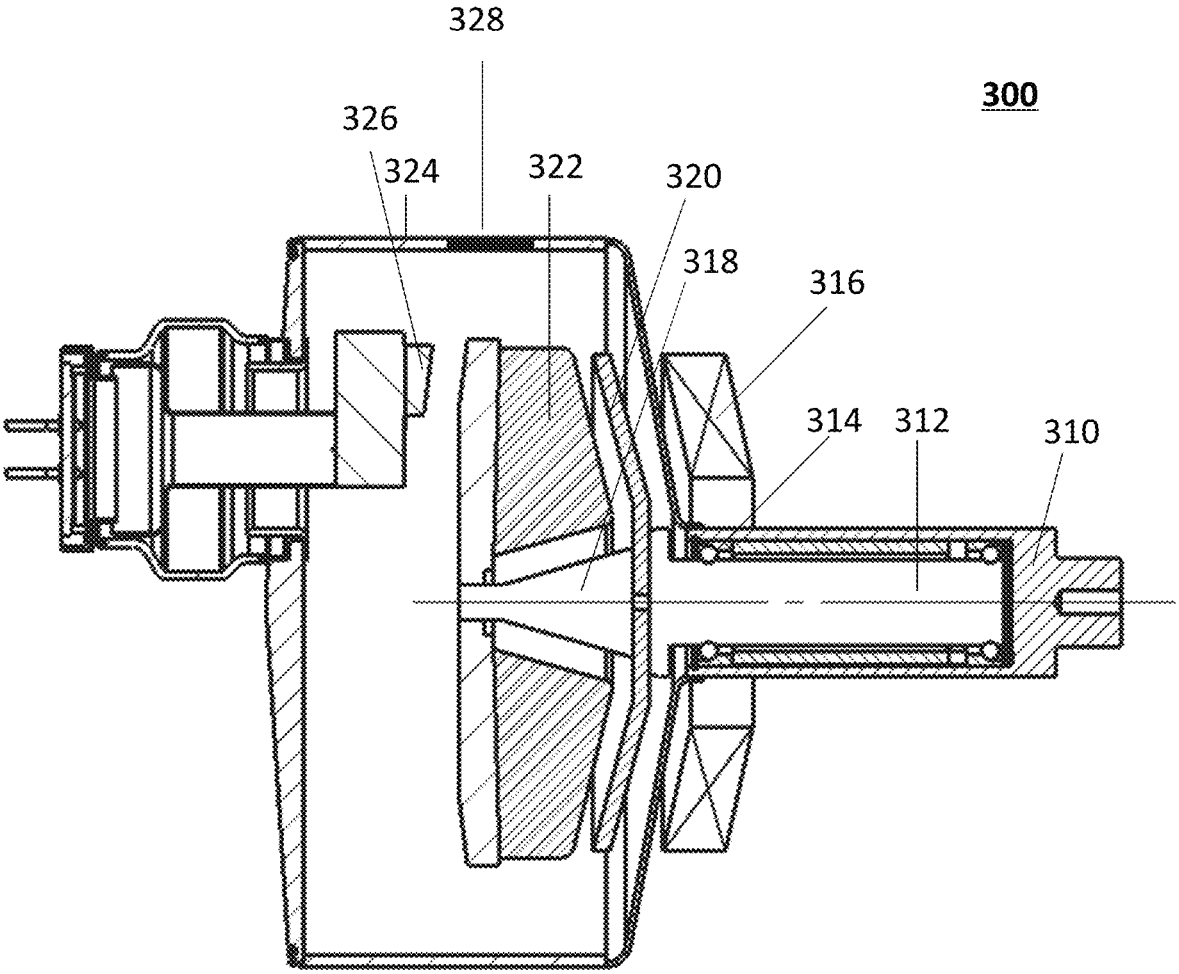
FIG. 3 is a sectional view of an exemplary radiation emission device according to some embodiments of the present disclosure.

FIG. 3 is a sectional view of an exemplary radiation emission device according to some embodiments of the present disclosure. As shown in FIG. 3, the radiation emission device 300 (e.g., an X-ray tube) may include a sleeve 310, a shaft 312, one or more bearings 314, a conical stator 316, a rotor flange 318, a rotor 320, an anode 322, an enclosure 324, a first cathode 326, and an irradiation window 328.

The first cathode 326 may include one or more first filaments configured to emit an electron beam. In some embodiments, the first filament may include a tungsten wire, an iridium wire, a nickel wire, a molybdenum wire, or the like, or a combination thereof. The first filament may emit a number of free electrons under the radiation voltage. These free electrons may be accelerated to strike the anode 322 to further generate the radioactive rays (e.g., the X-rays). In some embodiments, the first cathode 326 may include a plurality of first filaments of different sizes (e.g., different lengths and/or different diameters).

The anode 322 may be located opposite to the first cathode 326. When the first cathode 326 is powered by a certain voltage (e.g., the radiation voltage), electrons may be generated from the first cathode 326 and accelerated in an electric field between the first cathode 326 and the anode 322 to form an electron beam striking the anode 322. The anode 322 may be made of an electrically conductive material, have a high mechanical strength under a high temperature and have a high melting point. Exemplary materials may include titanium zirconium molybdenum (TZM), ferrum, cuprum, tungsten, graphite, or the like, or an alloy thereof, or any combination thereof.

Damages to the anode (e.g., crack on the anode) may occur if an electron beam strikes a cold anode (e.g., the anode 322 at the room temperature.) Before the first cathode 326 emits, under the radiation voltage, an electron beam to the anode 322, the anode 322 may need to be warmed up to a specific temperature or temperature range (e.g., 500 degrees Celsius to 1000 degrees Celsius). In some embodiments, the first cathode 326 may be configured to warm up the anode 322 by generating, under a heating voltage, an electron beam striking the anode 322. In the case, the service life of the first filament of the first cathode 326 may be decreased due to these additional loads for the warm-up. In addition, some high energy rays may leak from the irradiation window 328, resulting in radiation contamination. To protect the first filament, the radiation emission device 300 may include an extra heating device or component for preheating the anode 322. In some embodiments, the heating device may be located outside of the first cathode 326. More descriptions relating the first cathode 326 and the heating device may be found elsewhere in the present disclosure. See, e.g., FIG. 4 and the description thereof.

The anode 322 may be mounted on the rotor flange 318. The rotor flange 318 may be mechanically connected to the rotor 320. The rotor 320 may be driven to rotate by the conical stator 316. The rotation of the rotor 320 may further drive the anode 322 to rotate. The assembly formed by the anode 322, the rotor flange 318, and the rotor 320 may be supported by the shaft 312. The shaft 312 may be mechanically connected to the rotor flange 318 via, for example, a shaft flange. In some embodiments, the shaft flange and the rotor flange 318 may be fixed together by, e.g., a bolt structure.

The sleeve 310 may be configured to hold the shaft 312. The sleeve 310 may limit the motion of the shaft 312 to along the axial direction of the shaft 312, and allow the shaft 312 to rotate about its axis. Additionally, the sleeve 310 may limit the motion of the shaft 312 along a direction that is perpendicular to the axial direction of the shaft 312 via, for example, the bearing 314.

The enclosure 324 may house the rotor flange 318, the rotor 320, the anode 322, and the first cathode 326. The enclosure 324 may be hermetically sealed or airtight to maintain a vacuum condition inside the enclosure 324. In some embodiments, the enclosure 324 may be made of glass, ceramic, cermet, or the like, or any combination thereof.

The enclosure 324 and the sleeve 310 may form an integral structure in different ways. For example, the enclosure 324 may be connected to the sleeve 310 by welding, a mechanical element, or the like, or a combination thereof. Exemplary ways of welding may include shielded metal arc welding (SMAW), metal active gas welding (MAGW), metal inert gas welding (MIGW), gas tungsten arc welding (GTAW), resistance welding, or the like, or a combination thereof. Exemplary mechanical elements may include a bolt, a screw, a nut, a gasket, an airtight glue, an airtight adhesive tape, etc. In some embodiments, a first end of the sleeve 310 and one end of the enclosure 324 may be welded together, and a second end of the sleeve 310 that is opposite to the first end may reside outside the enclosure 324.

Both the enclosure 324 and the sleeve 310 may be immersed in a cooling medium in order for heat dissipation. The cooling medium may include a gas medium, a liquid medium, etc. In some embodiments, the gas medium may include air, an inert gas, or the like, or any combination thereof. In some embodiments, the liquid medium may include water, polyester (POE), polyalkylene glycol (PAG), or the like, or a combination thereof. In some embodiments, the enclosure 324 may remain to be vacuum. For example, the vacuum degree of the enclosure 324 may remain below 1 e-5 Pa, so that the electron beam may be accelerated directly towards the anode 322.

The rotor 320 may be located between the anode 322 and components enclosed in the sleeve 310 (e.g., the bearing 314). The surface of the rotor 320 facing the anode 322 may be flat or concave. The conical stator 316 may drive the rotor 320 to rotate by providing a magnetic field at the position of the rotor 320. The conical stator 316 may have the shape of a cone. Coils mounted on the conical stator 316 may generate a magnetic field that forms an oblique angle with the axial direction of the shaft 312. As used herein, the oblique angle may range from 0 to 90 degrees, or 10 degrees to 80 degrees, or 20 degrees to 60 degrees, or 30 degrees to 50 degrees, etc. The conical stator 316 may be mounted on the outer surface of the enclosure 324 or a retainer fixed on the enclosure 324.

This description is intended to be illustrative, and not to limit the scope of the present disclosure. Many alternatives, modifications, and variations will be apparent to those skilled in the art. The features, structures, methods, and other characteristics of the exemplary embodiments described herein may be combined in various ways to obtain additional and/or alternative exemplary embodiments. For example, the rotor flange 318 may be removed from the radiation emission device 100. The shaft 312 and the rotor 320 may be welded together or fixed together by a mechanical element (e.g., a bolt, a screw, a nut, a gasket, an airtight glue, an airtight adhesive tape). As another example, the conical stator 316 may be replaced with another stator that is capable of driving the rotor 320 to rotate. However, those variations and modifications do not depart the scope of the present disclosure.

Figure 4:
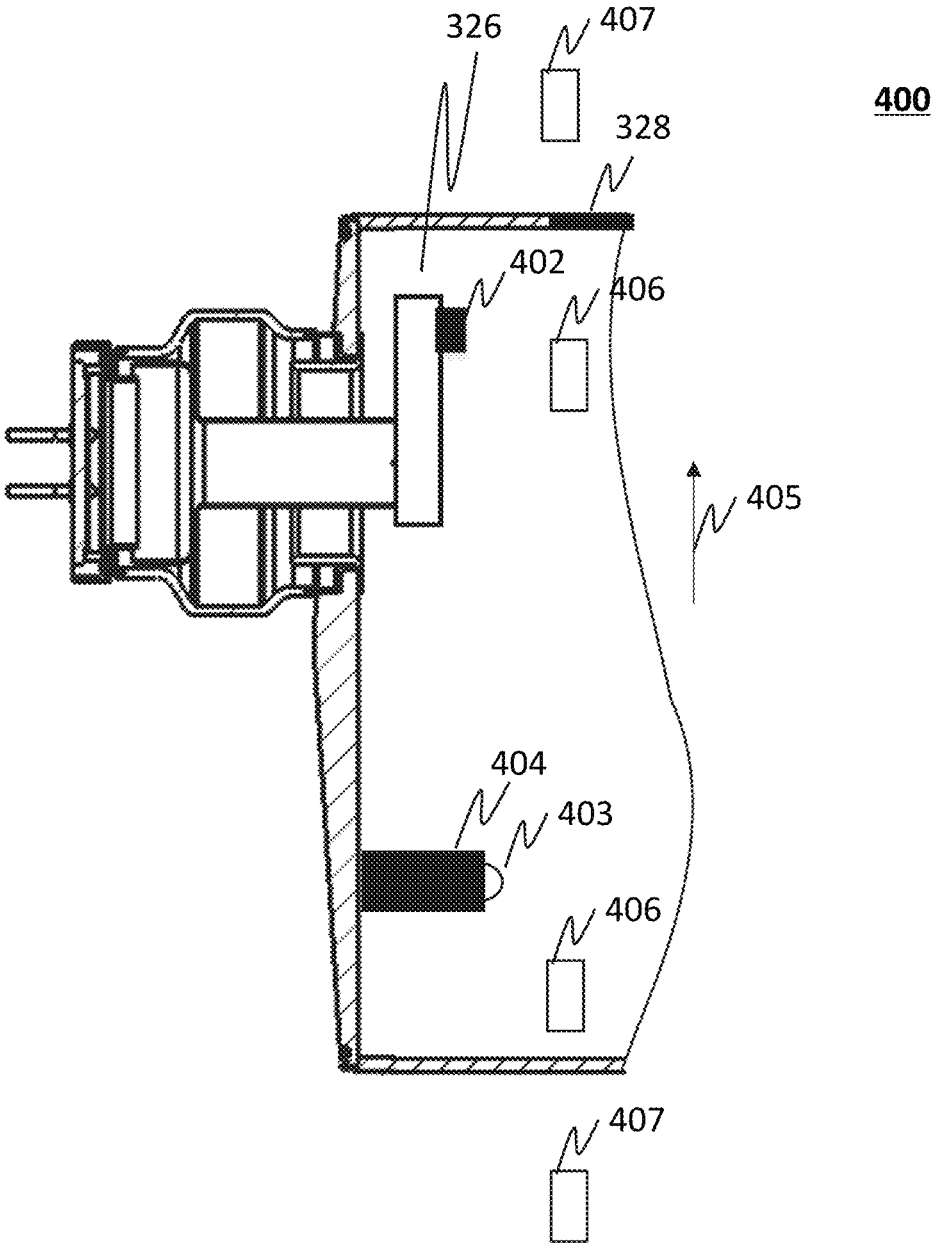
FIG. 4 is an enlarged view of a part of a radiation emission device according to some embodiments of the present disclosure.

FIG. 4 is an enlarged view of a portion of the radiation emission device 400 according to some embodiments of the present disclosure. The first filament 402 in the first cathode 326 may be configured to generate an electron beam under a radiation voltage. The heating device 404 may be configured to warm up the anode. The heating device may be located outside of the cathode. The heating device 404 may be located farther away from the irradiation window 328 than the first cathode 326. More specifically, a first distance between the irradiation window 328 and the heating device 404 may be bigger than a second distance between the irradiation window 328 and the first cathode 326.

In some embodiments, the heating device 404 may include a second cathode. The second cathode maybe a thermionic cathode or cold cathode. A cold cathode can emit electron beam under high electric field, i.e. field emission. A thermionic cathode can emit electron beam when heated to high temperature, such as 1000 to 2000 degree Celsius. The second cathode maybe a filament or a disk. For example, the second cathode may be a second filament 403 illustrated in FIG. 4. In some embodiments, the second filament 403 may include a tungsten wire, an iridium wire, a nickel wire, a molybdenum wire, or the like, or a combination thereof. In some embodiments, the second filament 403 may include a tungsten wire. By a conventional way for warming up the anode, a filament in the first cathode 326 may be used both to warm up the anode 322 and to generate electrons striking the anode 322 for generating radiation rays. Using such a filament in the first cathode 326, the warm-up of the anode 322 may take 10 minutes to 15 minutes. In some embodiments, using second cathode (e.g., the second filament 403) contained in the heating device 404, it may take no more than 10 minutes, or no more than 8 minutes, or no more than 6 minutes, or no more than 5 minutes, or no more than 4 minutes, or no more than 2 minutes, or no more than 1 minute to warm up the anode. In some embodiments, using second cathode (e.g., the second filament 403) contained in the heating device 404, it may take 1 minute to 10 minutes, or 1 minute to 8 minutes, or 1 minute to 6 minutes, or 1 minute to 5 minutes, or 1 minute to 4 minutes, or 1 minute to 2 minutes to warm up the anode. As used herein, the first filament refers to the filament in the first cathode 326 configured to generate electrons or an electron beam to strike the anode 322 so that the anode 322 generates radioactive rays for the purposes of, e.g., imaging, radiotherapy, etc. As used herein, the second filament refers to the filament in the heating device or component configured to warm up the anode 322 under the heating voltage. The diameter of the second filament 403 may be bigger than the diameter of the first filament 402. In some embodiments, the diameter of the second filament 403 may range from 0.05 mm to 0.8 mm. In some embodiments, the second filament 403 may be a coil including 1 turn to 100 turns. A pitch of the coil of the second filament 403 may range from 0.01 mm to 2 mm. In some embodiments, the heating device may be a metal disk that is able to emit the electron beams. The diameter of the disk may be from 1 mm to 100 mm. In some embodiments, the heating device may be a rectangular shape with a side dimension ranging from 1 mm to 100 mm.

In some embodiments, the second cathode (e.g., the second filament 403) may be further configured to move along a radial direction of the anode 322 during warming up the anode 322. The radial direction of the anode 322 may refer to a direction being parallel to a radius of the anode 322 (e.g., a direction 405 illustrated in FIG. 4). By moving the second cathode (e.g., the second filament 403) along the radial direction of the anode 322, the electron beam generated by the second cathode (e.g., the second filament 403) may strike different positions of the anode, and therefore the second cathode (e.g., the second filament 403) may warm up the anode 322 evenly. In some embodiments, an electromagnetic induction device may be placed between the second cathode (e.g., the second filament 403) and the anode 322. The electromagnetic induction device may be configured to generate a magnetic field when the second cathode (e.g., the second filament 403) warms up the anode 322. The direction of the electron beam emitted by the second cathode (e.g., the second filament 403) may be controlled by the magnetic field generated by the electromagnetic induction device. The electron beam may strike different positions of the anode by controlling strength of the magnetic field, and therefore the second cathode (e.g., the second filament 403) may warm up the anode 322 evenly. In some embodiments, the second cathode (e.g., the second filament 403) contained in the heating device 404 may generate an electron beam under the heating voltage. The electron beam generated by the second cathode (e.g., the second filament 403) may strike the anode 322 with a second focal spot on the anode 322 in the warm-up mode. The first filament 402 may also generate an electron beam having a first focal spot on the anode under the radiation voltage in the working mode. The size of the focal spot may depend on the size of filament (e.g., length of the filament.) The second focal spot generated by the second cathode (e.g., the second filament 403) may be bigger than the first focal spot generated by the first filament 402. The energy intensity of the electron beam generated by the second cathode (e.g., the second filament 403) striking on the anode 322 may be smaller, due to the bigger size of focal spot, than the energy intensity of the electron beam generated by the first filament striking on the anode 322. The anode does not break easily when the second cathode (e.g., the second filament 403) warms up the anode. The heating device may be located in positions that there is no direct pathway for x-ray generated at the anode to travel to the irradiation window. Such blockage of the x-rays may be realized by the anode material itself or any additional structure composed of materials that can attenuate x-rays. The location of the second cathode (e.g., the second filament 403) or heating device may be further optimized that is located at close proximity to the anode. The distance between the second filament and anode can range between 1 mm to 300 mm. The short distance between the second cathode (e.g., the second filament 403) and anode allows a low heating voltage and high heating current. The low heating voltage and high heating current allows to heating the anode quickly and generate a low energy and low density x-rays. Such x-rays can be easily blocked by x-ray attenuating materials such as anode, irradiation window or a plate outside the irradiation window or any structures consisting of x-ray attenuating materials.

In some embodiments, the heating device 404 may be an electromagnetic induction heating device (e.g., an electromagnetic induction heater). The anode 322 of the radiation emission device 300 may further include a resistance wire. The heating device 404 may generate electric current in the resistance wire, thereby generating heat so as to warm up the anode.

The anode 322 of the radiation emission device 300 may further include an inductive coil (e.g., inductive coil 406 or inductive coil 407 as illustrated in FIG. 4). The heating device 404 may cause electromagnetic induction under the heating voltage in the inductive coil, thereby generating heat so as to warm up the anode. In some embodiments, the inductive coil 406 may be located outside of the tube, around the anode. In some embodiments, the inductive coil 407 may be located inside of the tube, around the anode.

Figure 5:
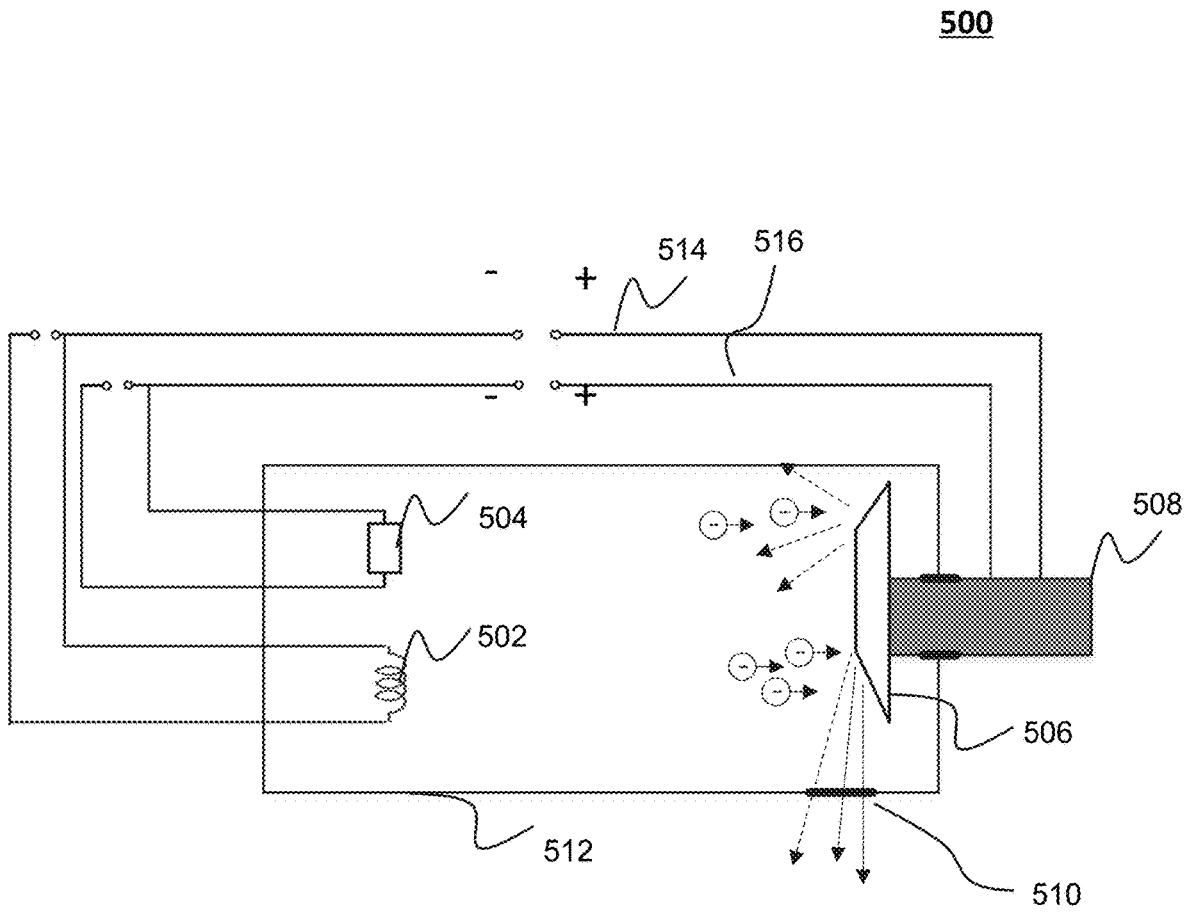
FIG. 5 is a schematic diagram illustrating an exemplary radiation emission device according to some embodiments of the present disclosure.

FIG. 5 is a schematic diagram illustrating an exemplary radiation emission device according to some embodiments of the present disclosure. As shown in FIG. 5, the radiation emission device 500 may include a first cathode 502, a heating device 504, an anode 506, a rotor 508, an irradiation window 510, an enclosure 512, an imaging power circuit 514, and a heating power circuit 516.

In some embodiments, the first cathode 502 may include one or more first filaments. The imaging power circuit 514 electrically connected to the first cathode 502 may supply a radiation voltage to the first cathode 502. The first filament contained in the first cathode 502 may emit the electron beams under the radiation voltage. The electron beams may strike the anode 506 to generate the radioactive rays. The radioactive rays may pass through the irradiation window 510 to irradiate a subject located in the pathway of the radioactive rays. It is understood that an imaging focal spot may be generated when the electron beams strike the anode 506. The smaller the imaging focal spot is, the clearer the generated image may be.

The heating power circuit 516 electrically connected to the heating device 504 may supply a heating voltage to the heating device 504 for warming up the anode 506. In some embodiments, the heating device 504 may be a second cathode. In some embodiments, the heating device 504 may include one or more second filaments. A second filament or a second cathode may emit electron beams under the heating voltage and generate a heating focal spot on the anode 506. In some embodiments, the radioactive rays may be generated when the electron beams, emitted by the second filament or the second cathode, strikes the anode 506. Compared with the radioactive rays generated by the first filament(s), the radioactive rays generated by the second filament(s) or the second cathode have lower energy intensity, and so they may be easy to be shielded by the enclosure 512. In some embodiments, the second filament or the second cathode may be located farther away from the window 510 than the first filament or the first cathode 502. In some embodiments, the radioactive rays generated by the second filaments or the second cathode may be blocked by the irradiation window 328 and essentially unable to penetrate through the irradiation window 510. Such blockage to the radiation generated from warm-up process can be further realized by additional shielding at outside of the window such that there is no radiation generated to the surrounding area during the warm-up process. For instance, the irradiation window 328 may further include a cover plate (not shown in FIG. 5) for blocking radioactive rays. The cover plate may include a material capable of absorbing at least a portion of the radioactive rays (also referred to herein as a "highly absorbing material"). Exemplary highly absorbing materials may include tungsten, lead, uranium, gold, silver, copper, molybdenum, plumbum, or the like, or an alloy thereof, or a combination thereof.

The heating device can heat up the x-ray tube for the tube warm-up purpose without generating x-ray radiation to the surrounding environment. The additional radiation to the surrounding environment is less than 10%, 100%, 200% or 400% of the natural background radiation.

In some embodiments, the imaging power circuit 514 and the heating power circuit 516 may be controlled by the high voltage generator 240. For example, if a user desires to warm up the anode 506 before using the radiation emission device to, e.g., perform a scan on the subject, the user may provide instructions so that the heating voltage is provided to the heating device via the high voltage generator 240. After the preheating is finished, the user may further provide instructions so that the radiation voltage to the first cathode 502 is provided to the radiation emission device. The first filament(s) in the first cathode 502 may emit an electron beam striking the anode 506 to generate radioactive rays for irradiating the subject for the purposes of, e.g., imaging, radiotherapy, etc.

In some embodiments, the warm-up or preheating before a normal operation (e.g., imaging, radiotherapy, etc.) of the radiation emission device 500 may be performed automatically. For instance, when the radiation emission device 500 receives an instruction to operate (e.g., imaging, delivery a radiotherapy session), the radiation emission device controller 250 may determine the status (idle, warming up, working, off, etc.) of the radiation emission device 500 and determine if a warm-up or preheating is needed. In some embodiments, the radiation emission device controller 250 may determine the status of the radiation emission device 500 based on, e.g., the temperature of the radiation emission device 500 or a portion thereof, or one or more status parameters of the radiation emission device 500, or the like, or a combination thereof.

In some embodiments, for those skilled in the art, the radiation voltage may be determined based on the type of the subject that needs to be irradiate. For instance, the radiation voltage may be set to 80 KV, 120 KV, 140 KV, etc. The heating voltage may be lower than the radiation voltage. For example, the heating voltage may be 0 KV to 30 KV. Due to the lower heating voltage, the radioactive rays generated by the second filament or the second cathode of the heating device 504 may have much lower energy intensity than the radioactive rays generated by the first filament of the first cathode 502. In some embodiments, the power of the heating device 504 may be set to 100 W to 10 KW to achieve the warm-up. The time for the heating device 504 to warm up the anode 508 may depend on the heating voltage and/or the power. In some embodiments, the time for heating the anode 506 may last for 0.1 minute to 5 minutes.

In some embodiments, the single first filament 502 may be also configured to preheat the anode. For example, the first filament 502 may emit an electron beam of first energy under the heating voltage. The first electron beam may be used to heat the anode 506. After warming up the anode, the first filament 502 may emit an electron beam of second energy for generating the radioactive rays for, e.g., imaging under the radiation voltage. The heating voltage may be lower than the radiation voltage, and therefore the intensity of the first energy electron beam may lower than the intensity of the second energy electron beam.

It should be noted that the above description of the embodiments are provided for the purposes of comprehending the present disclosure, and not intended to limit the scope of the present disclosure. For persons having ordinary skills in the art, various variations and modifications may be conducted in the light of the present disclosure. However, those variations and the modifications do not depart from the scope of the present disclosure.

Having thus described the basic concepts, it may be rather apparent to those skilled in the art after reading this detailed disclosure that the foregoing detailed disclosure is intended to be presented by way of example only and is not limiting. Various alterations, improvements, and modifications may occur and are intended to those skilled in the art, though not expressly stated herein. These alterations, improvements, and modifications are intended to be suggested by this disclosure, and are within the spirit and scope of the exemplary embodiments of this disclosure.

Moreover, certain terminology has been used to describe embodiments of the present disclosure. For example, the terms "one embodiment," "an embodiment," and/or "some embodiments" mean that a particular feature, structure or characteristic described in connection with the embodiment is included in at least one embodiment of the present disclosure. Therefore, it is emphasized and should be appreciated that two or more references to "an embodiment" or "one embodiment" or "an alternative embodiment" in various portions of this specification are not necessarily all referring to the same embodiment. Furthermore, the particular features, structures or characteristics may be combined as suitable in one or more embodiments of the present disclosure.

Further, it will be appreciated by one skilled in the art, aspects of the present disclosure may be illustrated and described herein in any of a number of patentable classes or context including any new and useful process, machine, manufacture, or composition of matter, or any new and useful improvement thereof. Accordingly, aspects of the present disclosure may be implemented entirely hardware, entirely software (including firmware, resident software, micro-code, etc.) or combining software and hardware implementation that may all generally be referred to herein as a "block," "module," "engine," "unit," "component," or "system." Furthermore, aspects of the present disclosure may take the form of a computer program product embodied in one or more computer readable media having computer readable program code embodied thereon.

A computer readable signal medium may include a propagated data signal with computer readable program code embodied therein, for example, in baseband or as part of a frame wave. Such a propagated signal may take any of a variety of forms, including electro-magnetic, optical, or the like, or any suitable combination thereof. A computer readable signal medium may be any computer readable medium that is not a computer readable storage medium and that may communicate, propagate, or transport a program for use by or in connection with an instruction execution system, apparatus, or device. Program code embodied on a computer readable signal medium may be transmitted using any appropriate medium, including wireless, wireline, optical fiber cable, RF, or the like, or any suitable combination of the foregoing.

Computer program code for carrying out operations for aspects of the present disclosure may be written in any combination of one or more programming languages, including an object-oriented programming language such as Java, Scala, Smalltalk, Eiffel, JADE, Emerald, C++, C#, VB. NET, Python or the like, conventional procedural programming languages, such as the "C" programming language, Visual Basic, Fortran 2008, Perl, COBOL 2002, PHP, ABAP, dynamic programming languages such as Python, Ruby and Groovy, or other programming languages. The program code may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider) or in a cloud computing environment or offered as a service such as a Software as a Service (SaaS).

Furthermore, the recited order of processing elements or sequences, or the use of numbers, letters, or other designations therefore, is not intended to limit the claimed processes and methods to any order except as may be specified in the claims. Although the above disclosure discusses through various examples what is currently considered to be a variety of useful embodiments of the disclosure, it is to be understood that such detail is solely for that purpose, and that the appended claims are not limited to the disclosed embodiments, but, on the contrary, are intended to cover modifications and equivalent arrangements that are within the spirit and scope of the disclosed embodiments. For example, although the implementation of various components described above may be embodied in a hardware device, it may also be implemented as a software only solution—e.g., an installation on an existing server or mobile device.

Similarly, it should be appreciated that in the foregoing description of embodiments of the present disclosure, various features are sometimes grouped together in a single embodiment, figure, or description thereof for the purpose of streamlining the disclosure aiding in the understanding of one or more of the various inventive embodiments. This method of disclosure, however, is not to be interpreted as reflecting an intention that the claimed subject matter requires more features than are expressly recited in each claim. Rather, inventive embodiments lie in less than all features of a single foregoing disclosed embodiment.

In some embodiments, the numbers expressing quantities, properties, and so forth, used to describe and claim certain embodiments of the application are to be understood as being modified in some instances by the term "about," "approximate," or "substantially." For example, "about," "approximate," or "substantially" may indicate ±20% variation of the value it describes, unless otherwise stated. Accordingly, in some embodiments, the numerical parameters set forth in the written description and attached claims are approximations that may vary depending upon the desired properties sought to be obtained by a particular embodiment. In some embodiments, the numerical parameters should be construed in light of the number of reported significant digits and by applying ordinary rounding techniques. Notwithstanding that the numerical ranges and parameters setting forth the broad scope of some embodiments of the application are approximations, the numerical values set forth in the specific examples are reported as precisely as practicable.

Each of the patents, patent applications, publications of patent applications, and other material, such as articles, books, specifications, publications, documents, things, and/or the like, referenced herein is hereby incorporated herein by this reference in its entirety for all purposes, excepting any prosecution file history associated with same, any of same that is inconsistent with or in conflict with the present document, or any of same that may have a limiting affect as to the broadest scope of the claims now or later associated with the present document. By way of example, should there be any inconsistency or conflict between the descriptions, definition, and/or the use of a term associated with any of the incorporated material and that associated with the present document, the description, definition, and/or the use of the term in the present document shall prevail.

It is to be understood that the embodiments of the application disclosed herein are illustrative of the principles of the embodiments of the application. Other modifications that may be employed may be within the scope of the application. Thus, by way of example, but not of limitation, alternative configurations of the embodiments of the application may be utilized in accordance with the teachings herein. Accordingly, embodiments of the present application are not limited to that precisely as shown and described.

In closing, it is to be understood that the embodiments of the application disclosed herein are illustrative of the principles of the embodiments of the application. Other modifications that may be employed may be within the scope of the application. Thus, by way of example, but not of limitation, alternative configurations of the embodiments of the application may be utilized in accordance with the teachings herein. Accordingly, embodiments of the present application are not limited to that precisely as shown and describe.

We claim:

1. A radiation emission device, comprising:

an anode;

a first cathode containing a first filament configured to emit an electron beam striking the anode to generate radioactive rays;

a heating device including a second cathode, being located outside of the first cathode, and being configured to warm up the anode, wherein the second cathode is further configured to move during warming up the anode, and wherein the second cathode is further configured to move along a radial direction of the anode that is parallel to a radius of the anode during warming up the anode; and an enclosure configured to enclose the first cathode and the anode.

2. The radiation emission device of claim 1, wherein the second cathode is a second filament or disk.

3. The radiation emission device of claim 2, wherein the second filament includes a tungsten wire, an iridium wire, a nickel wire, or a molybdenum wire.

4. The radiation emission device of claim 2, wherein a focal spot generated by the second filament is bigger than a focal spot generated by the first filament.

5. The radiation emission device of claim 2, wherein a diameter of the second filament is bigger than a diameter of the first filament.

6. The radiation emission device of claim 2, wherein the second filament is a coil including 1 to 100 turns, or a coil having a pitch ranging from 0.01 mm to 2 mm, or a coil with a diameter ranging from 0.05 mm to 0.8 mm.

7. The radiation emission device of claim 1, further comprising:

an imaging power circuit connected to the first cathode, wherein the imaging power circuit supplies a radiation voltage to the first cathode to emit the electron beam striking the anode to generate the radioactive rays for imaging;

a heating power circuit connected to the heating device, wherein the heating power circuit supplies a heating voltage to the heating device for warming up the anode, and the radiation voltage is higher than the heating voltage.

8. The radiation emission device of claim 7, wherein the heating voltage is 0 KV to 30 KV, or a power of the heating device is 100 W to 10 KW.

9. The radiation emission device of claim 7, further including an electromagnetic induction heating device.

10. The radiation emission device of claim 7, wherein the first filament is configured to emit an electron beam of first energy for heating the anode under the heating voltage, and emit an electron beam of second energy for generating the radioactive rays for imaging under the radiation voltage.

11. The radiation emission device of claim 10, wherein intensity of the electron beam of first energy is lower than intensity of the electron beam of second energy.

12. The radiation emission device of claim 7, wherein the radiation emission device further comprises an irradiation window allowing the radioactive rays to pass through to emit towards a subject, and a distance between the irradiation window and the heating device is bigger than a distance between the irradiation window and the first cathode.

13. A method for heating a radiation emission device of a non-invasive imaging system, the non-invasive imaging system including an anode, a first cathode, and a heating device located outside of the first cathode, the method comprising:

providing a heating voltage to the heating device to heat the anode; and providing a radiation voltage to the first cathode;

wherein the heating device includes a second cathode, and the second cathode is configured to warm up the anode and move along a radial direction of the anode that is parallel to a radius of the anode during warming up the anode.

14. The method of claim 13, further comprising:

generating a heating focal spot on the anode by applying the heating voltage to the heating device;

generating an imaging focal spot on the anode by applying the radiation voltage to the first cathode, wherein the heating focal spot is bigger than the imaging focal spot.

15. The method of claim 13, wherein the heating voltage is lower than the radiation voltage.

16. The method of claim 13, wherein the heating voltage is 0 KV to 30 KV.

17. The method of claim 13, wherein time duration for the heating device to heat the anode lasts for 0.1 minute to 5 minutes.

18. The radiation emission device of claim 1, wherein the radiation emission device further comprises:

a rotor configured to drive the anode to rotate on the shaft, the rotor being mechanically connected to the shaft, and a sleeve configured to support the shaft via at least one bearing.

19. A radiation emission device, comprising:

an anode;

a first cathode containing a first filament configured to emit an electron beam striking the anode to generate radioactive rays;

a heating device, and being configured to warm up the anode without generating x-ray radiation and to move along a radial direction of the anode that is parallel to a radius of the anode during warming up the anode; and an enclosure configured to enclose the first cathode and the anode.

* * * * *